United States Patent [19]

White et al.

[11] Patent Number: 4,724,779

[45] Date of Patent: Feb. 16, 1988

[54] COMBUSTION APPARATUS

[76] Inventors: John E. White, 76 High Street, Great Abington, Cambridge CB1 6AE; Kenneth S. Dunn, Stratton House, Chapel Lane, Easton, Huntingdon, Cambs. PE18 0TX, both of England

[21] Appl. No.: 921,134

[22] Filed: Oct. 21, 1986

[30] Foreign Application Priority Data

Jun. 26, 1986 [GB] United Kingdom ..... 8615634

[51] Int. Cl.[4] ..... F23H 7/08; F23H 7/14

[52] U.S. Cl. ..... 110/281; 110/165 R; 110/211; 110/214; 126/155; 126/174

[58] Field of Search ..... 110/281, 278, 165 R, 110/211, 214; 126/155, 174, 158; 414/156

[56] References Cited

U.S. PATENT DOCUMENTS

| | | | |
|---|---|---|---|
| 3,537,410 | 11/1970 | Zanft . | |
| 4,379,433 | 4/1983 | Huskinson | 110/214 |
| 4,452,152 | 6/1984 | John et al. . | |
| 4,471,704 | 9/1984 | John et al. . | |
| 4,491,077 | 1/1985 | Petty et al. | 110/281 X |
| 4,559,882 | 12/1985 | Dobson | 110/214 X |

FOREIGN PATENT DOCUMENTS

| | | |
|---|---|---|
| 0048089 | 3/1982 | European Pat. Off. . |
| 1299125 | 12/1972 | United Kingdom . |
| 2026146 | 1/1980 | United Kingdom . |
| 1570276 | 6/1980 | United Kingdom . |
| 2070212 | 9/1981 | United Kingdom . |

*Primary Examiner*—Edward G. Favors

*Attorney, Agent, or Firm*—Robbins & Laramie

[57] ABSTRACT

An incinerator comprises a combustion chamber 1 having a hearth comprising a grid 2, a vibrator 17 for vibrating the grid, and ash removal means 9, 18 for collecting ash that falls through the grid. The grid normally consists of a series of parallel bars and, when the hearth is elongated, these bars normally extend along the length of the hearth. The ash removal means comprises an inclined trough 9 and a hopper 18. Ash may be removed as a slurry. The incinerator comprises a sub-stoichiometric chamber to which is supplied insufficient oxygen for complete combustion Vibration of the grid allows ash to fall through the hearth and to be collected in the trough without ash causing abrasion to the incinerator components to improve the rate of burning. A preferred sub-stoichiometric chamber is separated from an ignition zone for a secondary chamber by a partition that defines a jacket around the zone, whereby improved heat exchange and compactness is achieved.

15 Claims, 8 Drawing Figures

COMBUSTION APPARATUS

The combustion of combustible solids, such as refuse, for instance municipal, hospital, domestic or industrial refuse, inevitably produces ash. The ash may be relatively small in volume but it may be very unpleasant to handle since it may contain finely divided minerals, metal oxides and other abrasive materials.

Various ways are known for handling this ash. For instance when the combustion chamber has a solid or fluidised bed hearth the ash may be removed by digging or scraping it from the hearth, when the chamber is not in use. Various ways of removing the ash continuously have been proposed. For instance in BP No. 1,299,125 a fluidised bed is described which has a circular motion so as to pass the ash continuously to an outlet. In BP No, 2,026,146 a fluidised bed is provided with a base that can be pivoted downwardly so as to discharge ash from the base without having to cool the chamber. a slab hearth may be reciprocated longitudinally. In general the known methods are not suitable for small units and are not suitable for sealed chambers.

A particular type of fluidised bed system is described in EP No. 0048089 in which an incinerator is provided with a grate that is oscillated vertically about a pivot, at one end of the grate, with a movement that is vertical and that does not generate substantial forward or rearward motion of the grate. The oscillation is intended to be applied continuously so as to keep the bed of fuel always in a fluidised state and to minimise any risk of the bed settling. This system will inevitably involve very heavy wear of the components and does not permit convenient removal of incombustible trash, such as metal cans or other incombustible material that may be introduced with the fuel.

It is also known to provide sub-stoichiometric and other combustion chambers with a hearth that reciprocates slowly, with a large amplitude of reciprocation, either to promote the feed of combustible material into the combustion chamber or to promote discharge of ash from the chamber. Reference should be made to, for instance, U.S. Pat. No. 3,537,410, 4,452,152 and 4,471,704. In each of these the hearth slopes downwardly from the inlet and vibrates longitudinally with respect to the inlet so as to carry fuel into the chamber or to discharge waste material from the far end of the chamber. In, for instance, U.S. Pat. No. 4,452,152 the hearth is made up of a series of blocks that are arranged stepwise in two longitudinal series, with a small transverse gap between the two series. The blocks are arranged in rows that extend transverse to the inlet with each row being stepped slightly down from the preceding row. The amplitude of vibration is large, e.g., 20 cm or more and the frequency of vibration is low, for instance up to 6 vibrations per minute, and is arranged so as to carry material from the inlet downwards into the chamber. Often there is little or no provision for air to flow up through the hearth although in U.S. Pat. no. 4,471,704 there may be some uncontrollable upward air flow due to inadequate fitting of adjacent blocks. The amount is insufficient for controlled combustion above the hearth and so combustion is due mainly to air that is supplied from a source above the hearth.

None of these systems provide an effective way of removing the ash from a combustion chamber, and especially none of them provide an effective way of both removing the fine ash and the coarse trash.

Particular problems arise where the chamber is to be operated sub-stoichiometrically and where the combustible gases produced in the sub-stoichiometric combustion chamber are led to a second chamber in which they may be burnt in the presence of additional oxygen, for instance as in GB No. 2,070,212. In a sub-stoichiometric combustion chamber it is essential to control the supply of air very accurately and yet continuous systems for the removal of ash from a combustion chamber are liable to permit uncontrolled entry of air. Accordingly it is generally necessary to remove the ash from such chambers batch-wise, when the chamber is not in operation.

In the sub-stoichiometric, primary, chamber combustion is conducted with an amount of oxygen that is below the stoichiometric amount that is required for full combustion such that pyrolysis, often accompanied by some combustion, occurs and the second stage is conducted in the presence of oxygen, generally in excess of that required for full combustion. An incinerator for this process generally comprises a primary, sub-stoichiometric, combustion chamber having an inlet for the combustible material and in which the combustible material is subjected to pyrolysis (and optionally some combustion) to produce a dirty, combustible, gas, (known as an off gas) and a second combustion chamber that receives the off gas and in which this gas is mixed with oxygen and is ignited and burnt in the presence of sufficient oxygen to permit combustion to go to substantial completion. The amount of oxygen required for this is generally above the total stoichiometric amount.

Typically the primary, sub-stoichiometric, combustion chamber is a relatively air-tight chamber whilst the secondary chamber is a separate chamber to which air is supplied in excess. The secondary chamber can in fact draw air in from the atmosphere, for instance as described in GB No. 1,570,276.

In the secondary chamber the off gases are ignited at the point where air is mixed with them and this part of the secondary chamber can be referred to as an ignition zone. It is very exothermic. The ignited gases then burn to substantial completion and the part of the secondary chamber in which they do this can be referred to as the combustion zone. The temperatures in the ignition zone and in the combustion zone are above the temperature of the off gases approaching the ignition zone since the ignition and subsequent combustion is exothermic.

The secondary chamber can be a single piece of apparatus or may be in two or more parts, for instance in one part of the apparatus combustion may go to partial completion and in a second part of the apparatus combustion may go to substantial completion, with oxygen being supplied between the two parts.

Although apparatus of this type, especially apparatus in which air is drawn into the secondary chamber by a venturi effect, as described in GB No. 1,570,276, has been very successful it does suffer from some inefficiency in that the secondary chamber is usually highly elongated, as a result of which the overall incinerator may be of an inconvenient size and shape, and there is considerable heat loss from the secondary chamber.

It is one object of the invention to provide an incinerator with improved means for removing ash. A further object of the invention is to provide an incinerator with improved means for removing ash that can fall through a hearth and coarse trash.

In particular one object of the invention is to provide an incinerator having a vibratable hearth.

Another object of the invention is to provide such incinerators wherein the hearth is in a sub-stoichiometric, primary, combustion chamber.

Another object of the invention is to provide a sub-stoichiometric incinerator that is of improved compactness and that gives improved combustion performance.

An incinerator according to the invention comprises a combustion chamber having an inlet for combustible material, a hearth comprising a grid, ash removal means for collecting ash that falls through the grid, and a vibrator, and the grid comprises substantially parallel bars having a spacing of about 2 to about 10 mm and is mounted for vibration by the vibrator at an amplitude of less than about 10 mm and a frequency of at least about 500 vibrations per minute. This incinerator may include a trash outlet positioned at one end of the said longitudinal bars for receiving trash off the grid and the vibration of the grid may be such as to move trash along the grid towards the trash outlet.

The combustion chamber may be a sub-stoichiometric, primary, combustion chamber having an outlet for off gases produced in the sub-stoichiometric chamber and the incinerator may then include a secondary combustion chamber for receiving the off gases from the primary chamber outlet and for combustion of them with oxygen.

The secondary chamber may comprise an ignition zone in which the off gases are ignited and which opens into a combustion zone in which the combustion is substantially completed and there may be an inlet for oxygen to the inlet zone and a path for off gases from within the primary chamber to the ignition zone and this path may provide indirect heat exchange contact between off gases approaching the ignition zone and the gases that are being burnt in the ignition zone.

Another type of incinerator according to the invention comprises a primary sub-stoichiometric combustion chamber having an inlet for combustible material, and a secondary combustion chamber for combustion of the off gases produced in the primary chamber and comprising an ignition zone in which the off gases are ignited and which opens into a combustion zone in which combustion is substantially completed, and there is an inlet for oxygen to the ignition zone and there is a path for off gases from within the primary chamber to the ignition zone and this path provides indirect heat exchange contact between off gases approaching the ignition zone and the gases that are being burnt in the ignition zone.

The invention is illustrated in the accompanying drawings in which.

Figure 4:
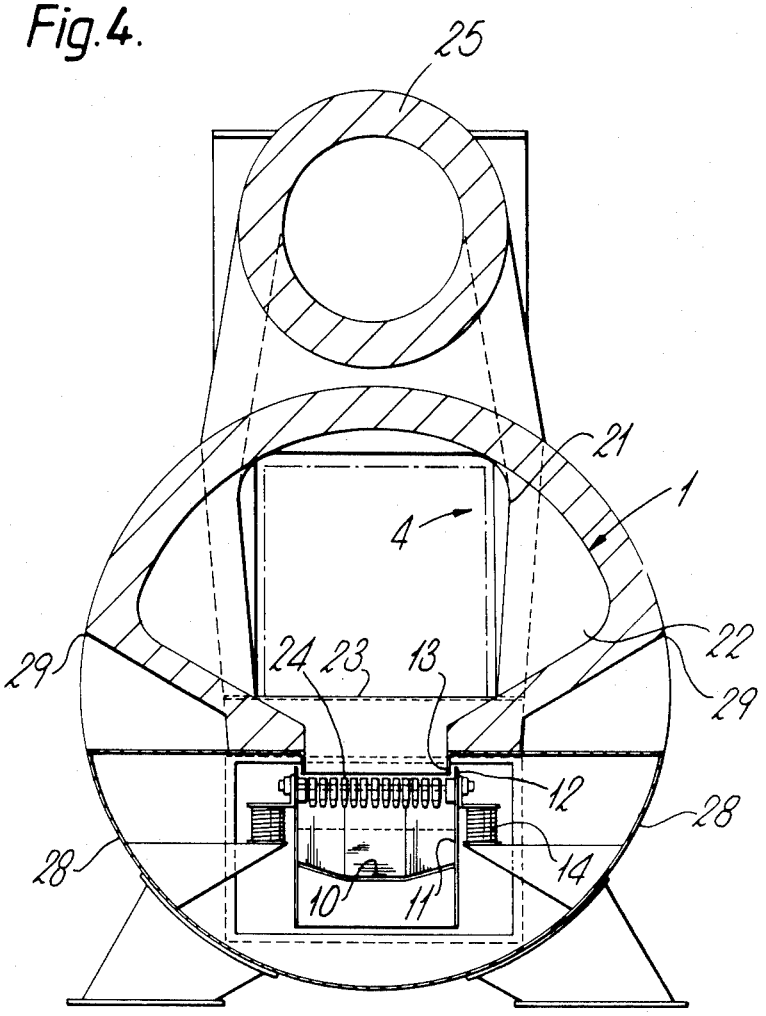
FIG. 4 is a section on the line IV—IV in FIG. 3.
Figure 5:
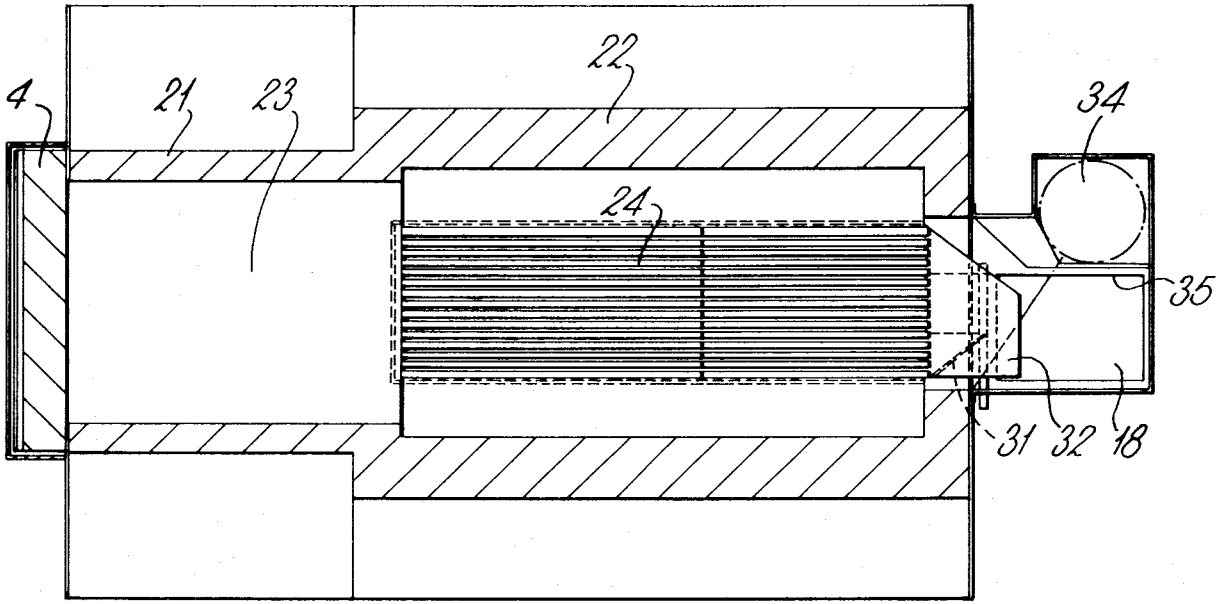
FIG. 5 is a section on the line V—V in FIG. 3.
Figure 6:
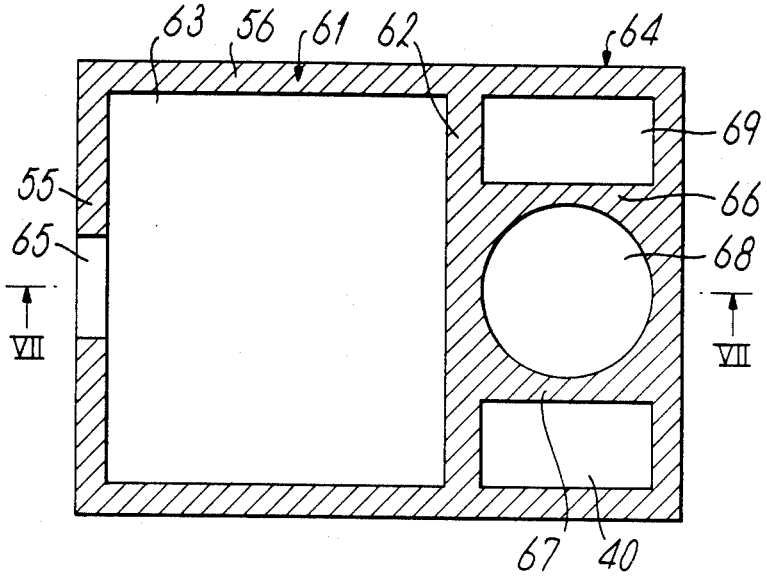
FIG. 6 is a diagrammatic plan view of another apparatus.
Figure 8:
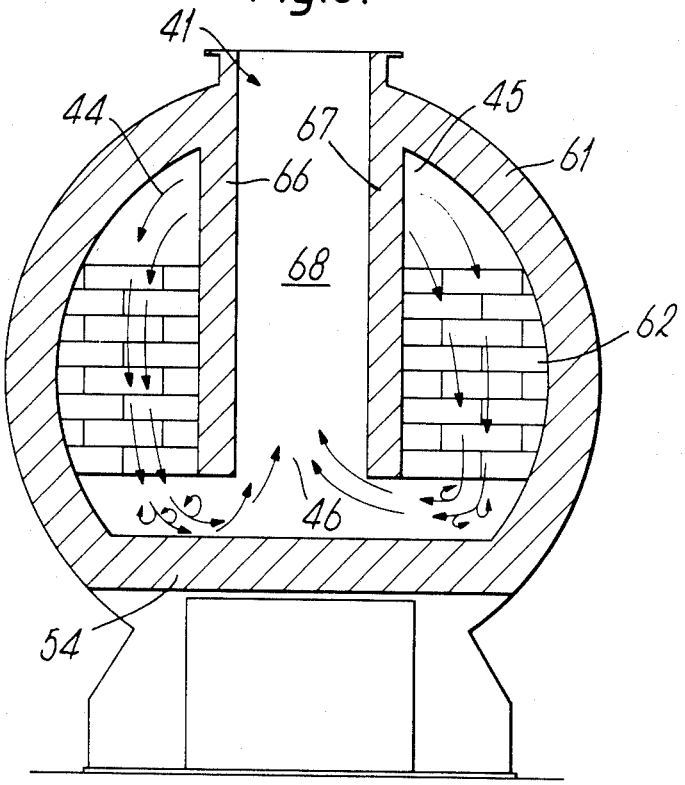
FIG. 8 is a vertical section on the line VIII—VIII in FIG. 7.
Figure 7:
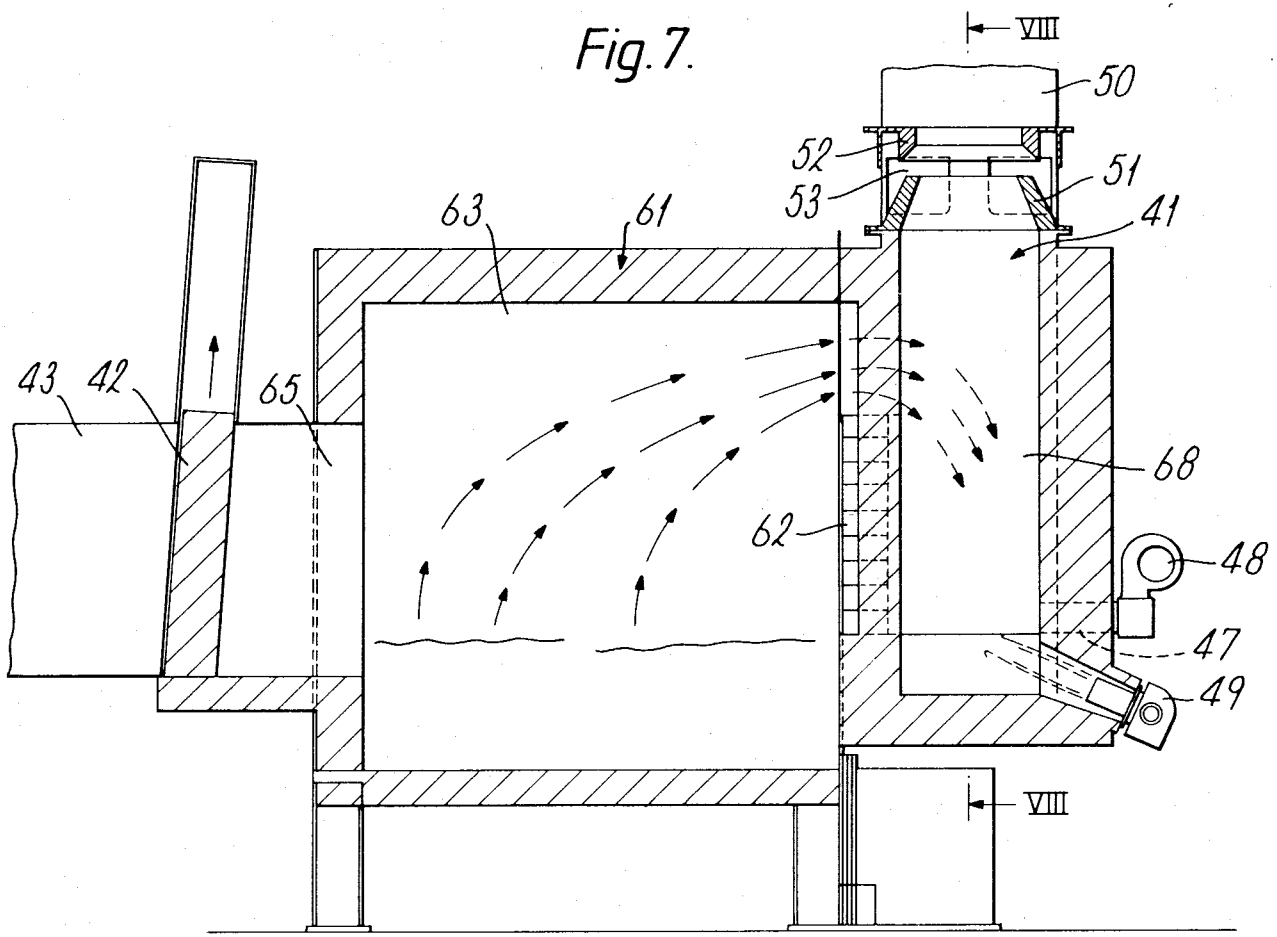
FIG. 7 is a vertical section through actual apparatus on the line VII—VII in FIG. 6.

The apparatus of FIGS. 6 to 8 is shown in the drawings, for simplicity, as having a solid hearth but preferably this hearth includes a vibratable grid as shown in FIGS. 1 to 5.

The grid normally consists of a series of parallel bars and, when the hearth is elongated, these bars normally extend along the length of the hearth. In addition to lengthwise bars there may also be transverse bars. However the bars normally extend lengthwise with respect to a trash outlet positioned at one end of the said longitudinal bars for receiving trash off the grid and it is then generally desirable to omit the transverse bars as their presence can impede the movement of the trash along the grid towards the trash outlet. This movement is caused by appropriate choice of the mode of vibration of the grid.

The spacing between each pair of adjacent bars is normally from about 2 to about 10 mm or more, often about 5 mm. The top of each bar may have small riffles, preferably arranged herring-bone fashion. The bars typically are about 2 to about 10 mm wide but may be wider, e.g., 20 mm.

The vibration should normally have vertical and horizontal components, with the horizontal component generally arranged such that solids on the hearth are moved by the vibration along the hearth towards a trash outlet for removing, e.g., cans, from the hearth. In some instances it may be possible to achieve, less satisfactorily, the desired movement ash, and sometimes also trash, even if the motion is only vertical or is only longitudinal. Preferably the motion is eliptical along the length of the bars.

The spacing between the bars and the amplitude of the vibration must both be very small and the vibration must be very fast and by this means it is possible to operate the chamber for most of the combustion period as if it were a solid chamber having an air supply throughout its base and that could be operated as a conventional fixed bed chamber having a uniform, sub-floor air supply (thereby giving the advantages of uniform air to solids throughout the base of the chamber) and ash can be allowed to build up on the bars during this normal combustion. However the high speed vibration then clears the ash in a relatively short time, and generally also removes the trash. Accordingly the precise dimensions of the spacing between the bars, the amplitude and the speed are controlled by the requirement to give uniform air supply, adequate support for the material in the chamber during normal combustion, and relatively speedy clearance of ash when vibration is applied.

The amplitude of vibration of the grid is generally at least about 0.5 mm and less than about 10 mm and most preferably less than about 5 mm, typically about 1 to about 3 mm. When the grid is being vibrated the frequency of vibration is generally above about 500 vibrations per minute, typically about 1000 to about 3600 vibrations per minute. It is generally not necessary, and may be undesirable, to vibrate the grid continuously during use of the chamber and instead the grid is usually maintained static for most of the time and is vibrated only for short intervals, as and when required to clear the hearth of ash. Typically the grid is static for more than 80% of the time the chamber is in use and typically is vibrated for a period of 5 seconds to 1 minute or sometimes longer, e.g., up to 5 minutes, normally at intervals of 1 to 12 hours, usually 2 to 8 hours.

Ash will fall through the grid during vibration, and possibly also while it is static, and the apparatus includes means for collecting this ash and permitting its eventual removal from the incinerator. Removal could involve, for instance, collecting the ash by suction but this creates certain technical problems and preferably the ash removal means comprises an trough that is beneath and at least substantially coextensive with the grid and a hopper into which the ash is discharged from an end of the trough. The ash can be flushed along the trough by fluid jets, preferably of water, towards the hopper but instead of or in addition to this flushing mechanism it is preferred to cause the ash to travel along the trough by vibrating the trough, preferably as a result of mounting the trough for vibration with the grid. Thus when the grid is vibrated ash is shaken through the grid and into the trough and is shaken along the trough towards and into the hopper. Movement of ash along the trough is facilitated by arranging the trough to be downwardly inclined towards the hopper.

In order to minimise the escape of ash from the trough, except into the hopper, it is desirable for the trough to be substantially sealed relative to the grid except at the lower most end, where the trough discharges into the hopper. The sealing may be caused by creating an air flow from around the edges of the trough towards and up through the grid, so that the upwardly and inwardly flowing air prevents ash from falling from the grid outside the trough, but preferably the sealing is provided by baffles that extend between the sides of the trough and the edges of the grid. These baffles may be flexible but are preferably rigid. They may contain apertures for the inflow of air to the grid from outside the trough but preferably are continuous. In the preferred construction the trough has a base plate and side walls, and the side walls are connected to the edges of the grid.

The vibrator is preferably a sealed unit that acts on the trough and grid that may be mounted on resilient supports. The vibration can therefore be provided without any substantial risk of ash entering miving parts and causing serious wear. Preferably the amplitude of vibration is substantially the same throughtout the area of the grid.

In order to avoid the risk of ash escaping from the grid and the trough or other ash removal means, and in order to regulate the air flow through the grid, it is preferred to provide a housing that extends from the chamber, encloses the ash removal means, and is open to the grid, and a blower or other means for creating a higher air pressure in the housing than in the chamber. The pressure differential between the housing and the chamber will be quite small and will provide substantially no restriction on the freedom of ash to fall through the grid and yet ash particles that become entrained in the air in the housing are carried back towards the grid and up into the chamber.

This is particularly valuable since it permits the provision of a gap between the chamber and the grid so as to permit the grid to be vibrated whilst the chamber and the housing are stationary, since air will then flow through this gap and carry back into the chamber any ash or other particulate material that might otherwise escape from the housing. This gap will normally be no greater than the amplitude of vibration, i.e. generally below 5 mm. Thus it is possible to arrange the incinerator such that the only part that vibrates is the grid (and possibly the associated trough) with the result that the desired vibration can be achieved without the need of diaphragms or other solid means for preventing the passage of solids from the chamber through the gap and enables the desired vibration to be achieved using a relatively weak vibrator.

The housing extends from the chamber in order that the walls of the housing form, with the walls of the chamber, an enclosure that will substantially retain the elevated pressure within the housing relative to the pressure above the grid. The housing is normally provided with a discharge outlet to permit removal of ash from within the housing. As the housing is generally at a pressure above atmospheric pressure there will be a loss of pressure, and possibly escape of ash, if the outlet is merely a port that can be opened to the atmosphere. The outlet is therefore preferably provided with means permitting the removal of ash without substantially exposing the interior of the housing to the atmosphere.

Preferably, the hopper is secured and sealed to the trough and vibrates with the trough and serves also as a collector for the trash. It can be provided with a removable lid which will provide adequate air lock during normal combustion and will prevent escape of dust during vibration. The hopper is preferably provided with automatic emptying means for the ash and the trash or may be removable so that it can, when necessary, be taken from the chamber and emptied by tipping.

In general it is desirable for the outlet to be provided with an air lock having an inlet and an outlet whereby the ash can be collected through the inlet while the outlet of the air lock is closed and then, when the inlet of the air lock is closed, the outlet is opened to discharge the ash. For instance the ash removal means may include a water supply and a water tight hopper into which ash that has fallen through the grid may be collected as a slurry and the outlet from the housing is located in this hopper such that, when the outlet is open, the slurry provides a liquid seal between the housing and the atmosphere.

Preferred systems according to the invention comprise an inclined trough that will discharge into a hopper at its lower most end and that is substantially sealed with respect to the hearth along its other edges and a housing that extends from the chamber as described above, and as a result it is possible to control very accurately the supply of air to the grid, by appropriate control of the blower or other means for creating elevated pressure within the housing. This is particular value when the combustion chamber is to be operated as a sub-stoichiometric chamber. The combustion chamber may be an elongated chamber having a feed end provided with an inlet for combustible material and a closed end and the lower most end of the trough is preferably adjacent the closed end of the chamber whereby the majority of air entering the chamber enters it adjacent the closed end. Thus the majority of the air is available for combustion of feed that has travelled along the length of the chamber, and the amount of air available for combustion of freshly introduced feed is very low. This promotes controlled sub-stoichiometric combustion. This controlled travel of air along an elongated chamber forms an essential feature of a second aspect of the invention. The total amount of air supplied to the chamber is generally below 30% of the stoichiometric amount.

In another preferred combust on chamber, especially when it is designed for sub-stoichiometric combustion, there is an inlet for combustible material at one side of the chamber, the outlet for ash and trash at a first end and an outlet for off gases to a second combustion chamber at the second end. The first end is often provided with a door by which it is possible to obtain access to the chamber.

In all sub-stoichiometric chambers of the invention it is generally preferred for the inlet to include a guillotine door and an automatic feed through the door for the combustible material, e.g., as bags or bales. This facilitates automatic control of combustible material and control of the amount of oxygen in the chamber.

The vibrating grid can be used in a wide variety of combustion chambers, including both those utilising an excess of oxygen, for instance as a result of being substantially open to the atmosphere, but is of particular value in sub-stoichiometric chambers.

Another incinerator may comprise a substoichiometric combustion chamber that is elongated and has a feed end including an openable inlet for baled combustible solids, a closed end, and means for supplying air substantially only into the closed end, a bale feed for charging combustible solids through the inlet as a bale that substantially fills the cross-section of the feed end, a secondary combustion chamber to which air can be supplied, and a duct leading the combustible gas produced in the substoichiometric chamber from that chamber, at a position adjacent the said inlet, to the second combustion chamber, whereby a bale introduced in the feed end is located between air entering the substoichiometric chamber and the duct to the second chamber. The substoichiometric chamber of this aspect of the invention may be provided with a conventional, for instance solid, hearth that may be cleared of ash as and when necessary either manually or continuously, by known means. Preferably however part at least of the hearth of the substoichiometric chamber is a vibratable grid as described above.

It is preferred that the freshly introduced bale is, after initial pyrolysis in the feed end, caused to drop down onto the hearth of the chamber. This may be achieved by appropriate design of the walls of the chamber but conveniently the feed end and the closed end have separate hearths and the hearth of the closed end is lower than the hearth of the feed end and there is a step down between the hearths. Thus as the bale is pushed towards the closed end it will drop down this step onto the lower hearth. Preferably the hearth of the feed end is solid. Any ash on this hearth will be pushed inwards by an incoming bale. Preferably the hearth of the closed end is a vibratable grid as described above. The feed end of the chamber may have a length such that it holds a single bale or two or more bales. The closed end will usually have a length such that it holds two bales, but may hold three or more.

Although small amounts of air may enter the substoichiometric chamber around, for instance, the inlet for the bale or along the length of the hearth of the chamber the majority of the air enters at or near the closed end so that the path of the majority of the gas flow from that end is over and around the most recently charged bale and then through the duct towards the second combustion chamber. In practice it is preferred that substantially all the oxygen that enters the chamber is used up in substoichiometric combustion of the bale or bales in the closed end with the result that the gas contacting the most recently introduced bale, in the inlet end, is substantially free of oxygen but consists mainly of $N_2$, CO, $CO_2$ and dissociated hydrocarbons. That bale is therefore subjected primarily to pyrolysis, for instance at a temperature of 800° C.

As the recently introduced bale substantially fills the cross-section of the feed end this restricts the flow of gas around it and the pyrolysis occurs mainly on the surface of the compressed bale. Closer to the closed end, however, the bales will have loosened, partly as a result of combustion or pyrolysis and partly because of, for instance, the drop down onto the lower hearth and as a result the gas can penetrate the mass that has already been partially pyrolised while it was at the feed end of the chamber.

The air supply to the closed end may be by, for instance, a conventional perforated pipe wherein the perforations are located within the combustion chamber to give the desired relative rates of flow of air at different places within the chamber, but generally the air supply is provided through the heart and/or at an inlet in the extreme end of the closed end of the chamber. Preferably this is achieved by providing a housing that extends from the chamber and an inclined trough that is sealed to the grid but that discharges from and is open at an end adjacent the closed end of the chamber, as described above.

The invention relates also to an incinerator that comprises a primary sub-stoichiometric combustion chamber and that may be provided with a conventional, non-vibrating hearth but that preferably is provided with a vibrating hearth as described above. In these sub-stoichiometric combustion chambers the secondary combustion chamber to which off gases from the primary chamber are fed comprises an ignition zone, there is an inlet for oxygen to the ignition zone and there is a part for off gases from within the primary chamber to the ignition zone and this path provides indirect heat exchange contact between off gases approaching the ignition zone and the gases that are being burnt in the ignition zone.

Part or all of the path for off gases from within the primary chamber may involve travel along one wall of the primary chamber, when that wall defines part of the side wall of the ignition zone. Preferably however the path includes a jacket extending around part at least of the ignition zone between an outlet for off gas from the primary chamber and an inlet for off gas into the secondary chamber.

Thus in the invention some of the heat of combustion in the ignition zone is collected by off gases approaching the ignition zone, with the result that they can be at a higher temperature when they enter the ignition zone. Also, since at least part of the walls of the ignition zone are in indirect heat exchange contact with the off gases, instead of with the atmosphere, heat loss to the atmosphere is reduced.

A particular advantage of the invention is that it is possible to achieve this reduction in heat loss and provide an incinerator of a much more convenient design and shape. In particular the incinerator preferably comprises a refractory housing divided by a partition into the primary chamber and a secondary portion, the secondary portion is divided by a wall into the ignition zone and the jacket, and the path comprises an aperture through the partition into the jacket, the jacket and an inlet into the ignition zone at a position distant from the aperture.

The partition is preferably a substantially vertical transverse partition and the ignition zone is substantially vertical. The aperture through the partition is preferably at or near its top. Generally there are two such apertures. Such an incinerator gives a particularly convenient combination of compactness and operating efficiency. Preferably the incinerator has the shape of a cylinder but it may be, for instance, cubic. The inlet can be through the wall opposite the partition or may be in a side wall. In all sub-stoichiometric chambers the inlet for combustible material often includes an automatically operated guillotine or other door associated with a ram or other automatic feeder and then it can be convenient to provide a manually operated inlet elsewhere into the primary chamber and/or an automatic ash removal system (such as described above) to permit removal of ash.

A preferred incinerator comprises a primary sub-stoichiometric combustion chamber having an inlet for combustible material, a secondary combustion chamber for combustion of the off gases produced in the primary chamber and comprising an ignition zone having an inlet for oxygen and in which the off gases are ignited and which opens into the combustion zone in which combustion is substantially completed, and the incinerator comprises a refractory housing divided by a substantially vertical partition into the primary combustion chamber and a second portion, the second portion is divided by a substantially vertical wall into the ignition zone and a substantially vertical jacket that surrounds part at least of the ignition zone and the ignition zone extends vertically upwards into the combustion zone, and in which there is at least one aperture through the partition at or near its top into the jacket for passage of off gas from the primary chamber into the jacket, and there is an inlet for off gas from the jacket into the ignition zone at a position below and distant from the aperture or apertures.

Figure 1:
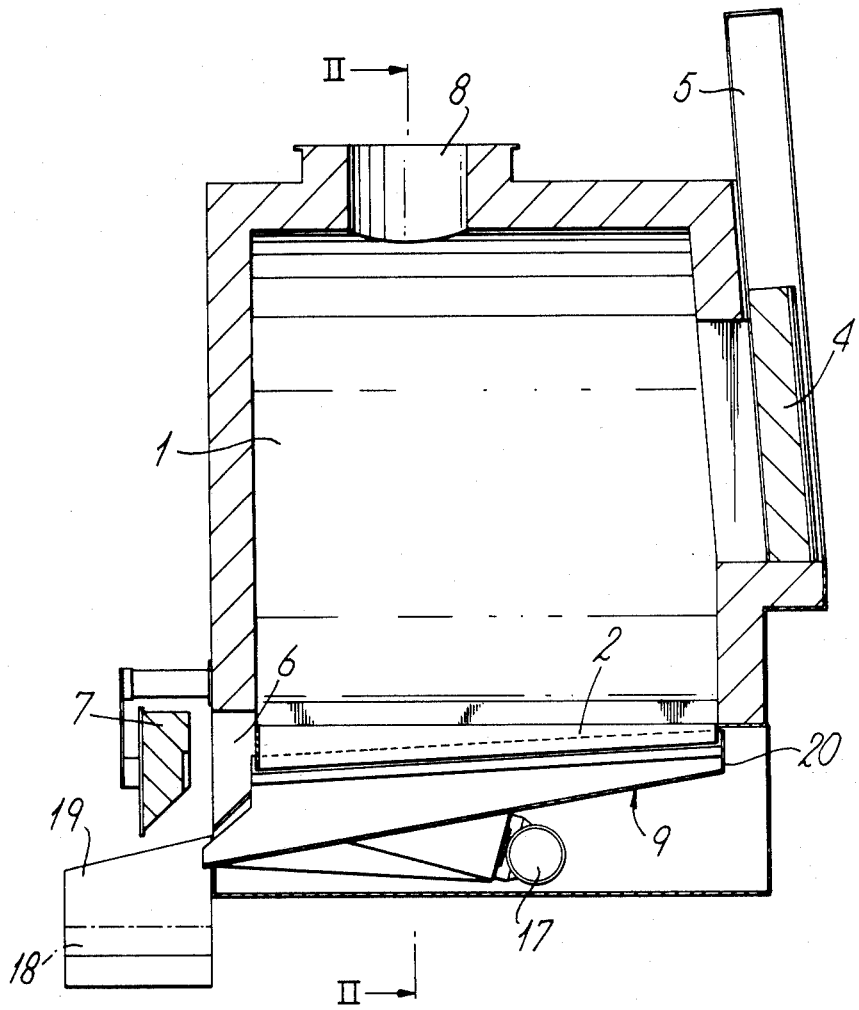
FIG. 1 is a vertical cross-section of one form of incinerator according to the invention.
Figure 2:
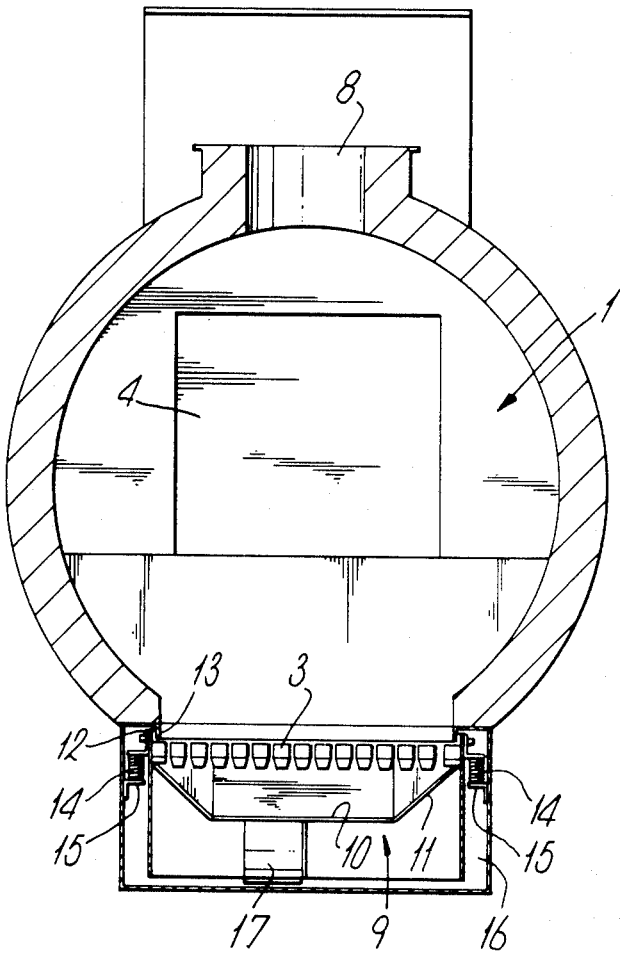
FIG. 2 is a section on the line II—II in FIG. 1.

The incinerator shown in FIGS. 1 and 2 comprises a combustion chamber 1 having a hearth that is provided by a grid 2 of parallel bars 3 that extend along the length of the chamber and that have a narrow separation from one another. The chamber is provided with an inlet door 4 that can be raised substantially vertically in guides 5 to permit charging of combustible material into the chamber. The chamber is also provided with a trash outlet 6 that, in normal operation, is closed by a plug door 7. A flue 8 leads from the top of the chamber to a stack (not shown).

An inclined trough 9 extends along the length of the grid and is formed of a base plate 10 and side walls 11. The side walls 11 are secured to the outer edges of the grid and at least one L piece 12 is secured to each wall. A flange 13 extends downwards from the chamber, its lower edge being below the upper edges of the side walls so that a narrow gap is defined between the walls and the flange 13.

The L members 12 are supported by resilient springs 14 that are mounted on members 15 that are secured to a rigid base 16. An eccentric motor 17 is connected to the base of the trough and, when operated, causes the unit consisting of the members 12, the grid 2 and the trough 9 to vibrate while the chamber 1 and the base 16 remain stationary.

The trough 9 is downwardly inclined at an angle of, typically, 5° to 15°, generally about 10° and so vibration of the trough and hearth will cause the ash that falls through the trough onto the base plate 10 to be conveyed down into a hopper 18.

The hearth 2 may also be inclined so as to shake coarse non-combustible refuse towards the outlet 6. The plugdoor 7 and the top 19 of the hopper may be opened when necessary to permit this refuse to be shaken into the hopper 18 or separate means of collecting the non-combustible refuse from the outlet 6 may be provided. Ash and refuse may be removed from the hopper 18 by opening its top 19. During normal operation the top 19 of the hopper 18 is kept closed.

A water supply may be provided into the hopper 18 in order that the ash that is shaken into the hopper 18 is present as a slurry and an appropriate outlet is provided in the hopper for removal of this slurry.

Air is permitted to enter the chamber freely, for instance through the hearth 2, and secondary air may be admitted into the chamber 1. The material that is charged through the door 4 may be any solid combustible material but is typically municipal, hospital, domestic or industrial refuse. It may be introduced loose, in bags, or, preferably, in bales.

If it is desired to operate the incinerator shown in FIGS. 1 and 2 as a sub-stoichiometric combustion chamber then it is necessary to control carefully the amount of air that enters the chamber and in particular it is necessary to construct the trough 9 and the hopper 18 so as to permit only a regulated amount of air through the hearth 2. When the chamber 1 is operating as a sub-stoichiometric chamber the outlet 8 will normally lead to a secondary combustion chamber to which additional air is supplied, for instance as described in GB No. 2,070,212.

Figure 3:
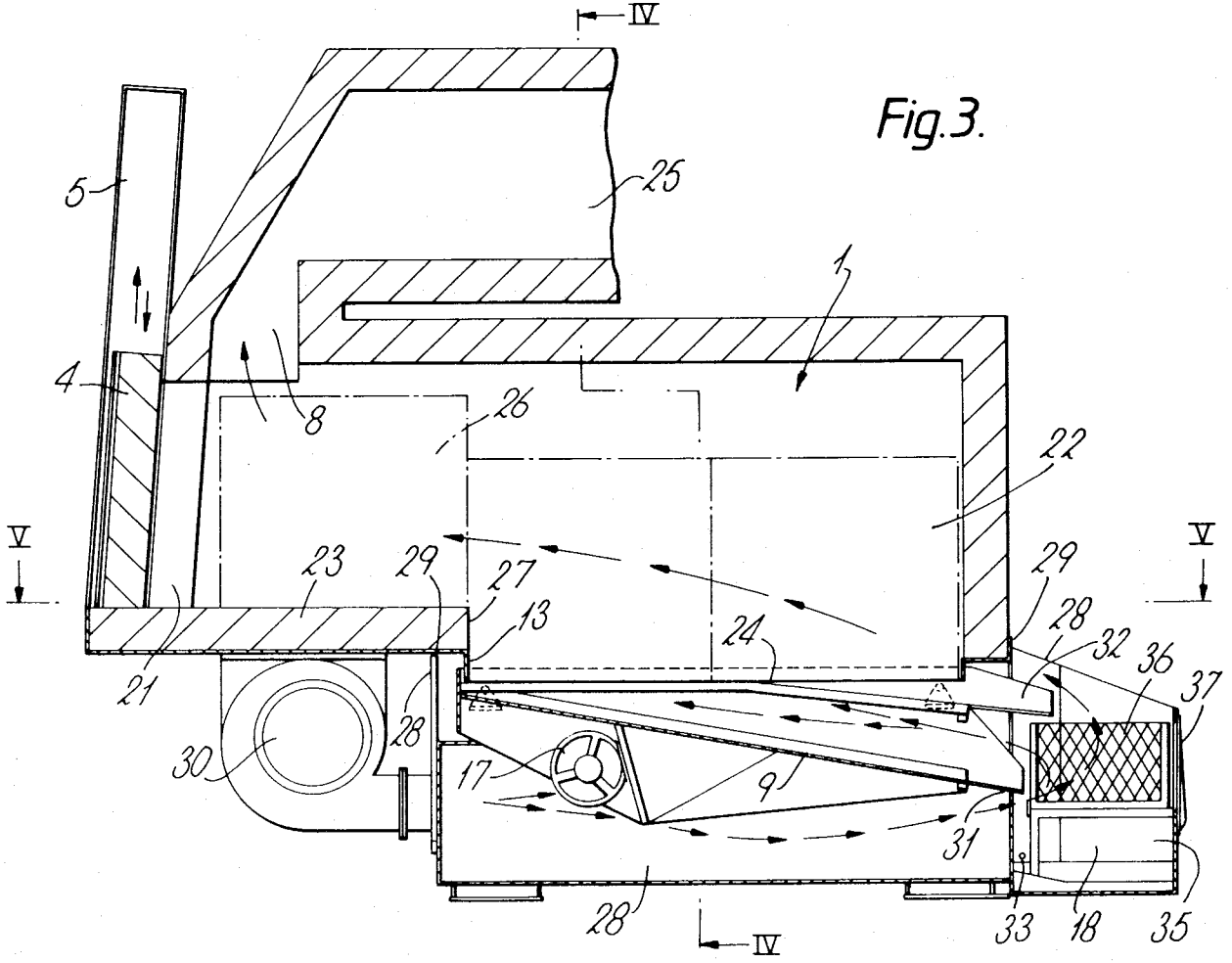
FIG. 3 is a vertical cross-section through another form of incinerator according to the invention.

An arrangement for the hearth in a sub-stoichiometric chamber is shown in more detail in FIGS. 3 to 5, which also shows an alternative form of combustion chamber.

Referring to FIGS. 3 to 5, the combustion chamber 1 is formed of two parts, a feed end 21 at which the inlet door 4 is positioned and a closed end 22. Each end, or zone, has its own hearth, the hearth in the feed end or zone 21 being a solid hearth 23 and the hearth in the closed zone 22 being a vibratable grid 24.

The feed zone 21 has a cross-section only very slightly greater than the cross-section of the door opening 4, which cross-section is only slightly greater than the cross-section of bales formed by a bale feed (not shown). The bale feed may comprise a baling mechanism that forms refuse into bales of the desired size or may simply feed preformed bales into the chamber. Preferably the transverse width of the hearth 23 is substantially the same as the width of the door 4 and the walls of the chamber are inclined slightly outwards. The bales that enter through it in order that the bales thus are a relatively tight fit along the base of the closed zone and gases passing over the bale in the closed zone therefore travel primarily along the sides and over the top surface of the bales. The outlet 8 from the combustion chamber is located distant from the closed end so that air entering the chamber at the closed end has to travel over a freshly introduced bale, in order to escape from the sub-stoichiometric chamber 1. The outlet 8 leads to a secondary chamber, the entry to which is shown diagrammatically as 25. It may be supplied with a venturi or other air supply, for instance as described in GB 2,070,212.

In operation, the door 4 is opened, a new bale 26 is rammed into the inlet end 21 of the chamber, and the door 4 is immediately closed again. The act of ramming the new bale 26 into the chamber forces the previously introduced bale on hearth 23 towards the closed end. It is held above the level of the hearth 24 by the configuration of the walls of the closed end and by the hearth 23 but eventually falls down the step 27 to the lower hearth 24, of the closed end 22. This helps to shatter the bale and expose the interior of it to combustion gases. The movement of this previous bale into the closed zone 22 does, in turn, force towards the right hand end of that zone the residue of the bale introduced previously. Thus, in this preferred process of the invention, air is introduced primarily at one end of a sub-stoichiometric combustion chamber and combustible gases are removed from the other and bales of combustible material are fed from the gas removal end to the air inlet end so that the air initially contacts the refuse that has been combusted to the greatest extent and the gases finally contact freshly introduced combustible material.

As the chamber is to be operated substoichiometrically it is necessary carefully to regulate the flow of air into the chamber and this is achieved by providing a housing 28 that extends with relatively air tight contact from the chamber, for instance at points 29. The housing 28 provides a relatively air tight zone but the housing is open to the grid 24 so that air can reach the inside of the chamber 1. It may be open over the entire length of the grid or only at the extreme end, distant from the inlet 4. A blower 30 forces air into the housing at controlled rate. An eccentruction motor 17 and a trough 9 are provided as in the construction shown in FIGS. 1 and 2, the trough 9 including a base 10 has side walls 11 connected to the edges of the grid 24 and is mounted for vibration on springs 14 with a small gap between members 12 and 13, all as in FIGS. 1 and 2. The member 13 is provided by an internal shroud plate that extends downwardly from the chamber 22 along its side walls and the end adjacent the step 27 so that the only access for air into the chamber 1 is through the gap along these two side walls and end between the member 12 and the shroud plate 13 and around the discharge end 31 of the trough, for instance following the dotted arrows shown in FIG. 3. Air passing around the discharge end 31 partly flows up through the trough and the grid 24 along its length and partly over the discharge end 32 of the grid.

The discharge end 31 discharges ash into hopper 18 containing a water supply pipe 33 that will convert ash in the hopper into a slurry. This slurry is removed from the hopper by a sump pump 34 but a shroud plate 35 extends into the slurry throughout its removal so as to retain a water seal between the discharge by the pump 34 and the interior of the housing.

A basket 36 is provided to collect non-combustible refuse that is shaken off the grid 24 and this is removed through a door 37 when necessary.

In the construction illustrated, the trough 9 may have an angle of around 10° whilst the grid 24 is shown as having two sections, one section substantially horizontal and the other having an inclination of about 8°. Alternatively the entire grid can be given a gentle inclination, for instance about 2°. Each of the bars forming the grid 24 may be typical wedge screen bars or may have riffle tops.

In a typical process the bale size will have each dimension above 500 mm, for instance 750×750×850 mm and a compacting ratio in the range 10:1 to 30:1, preferably around 20:1 and the bale will have a weight of 100 to 300 kg, typically about 200 kg. The feed zone 21 has the same length as one bale and the closed zone 22 has the length of about two bales. The vibrator 17 causes the trough 9 and the grid 24 to vibrate at about 1500 vibrations per minute with an amplitude of about 3 mm. Air is forced into the housing 28 by blower 30 at whatever rate is theoretically required for the desired sub-stoichiometric combustion, this rate being calculated having regard to the calorific value of the bales being charged.

In use, bales are charged gradually into the combustion chamber with an ignition burner (not shown) being provided to initiate ignition of the bales. After, typically, about one hour an approximate steady state is reached and thereafter a fresh bale is charged through the door 4 at the appropriate rate, as the previous bale is pyrolised and the entry of each bale forces the previous bales in the chamber into the closed end 22. As exfoliation of a bale in zone 21 proceeds that bale, which is initially supported by the side walls and the hearth of the zone 21, will eventually collapse down the step 27 onto the hearth 24. The vibrator is vibrated as and when necessary. The sump pump 34 may operate continuously but generally operates only when the sump becomes filled.

The apparatus shown diagrammatically in FIG. 6 comprises a refractory housing 61 divided by a transverse partition 62 into a primary combustion chamber 63 and a secondary portion 64. The primary combustion chamber is provided with an inlet 65, distant from the partition 62, for combustible material.

The secondary portion 64 is divided by vertical walls 66 and 67 into a central portion 68 which serves as the ignition zone and two outer portions 69 and 40 that serve as a jacket for the ignition zone.

Referring in more detail to FIGS. 7 and 8, the incinerator comprises a substantially horizontal substabtially cylindrical refractory housing 1 divided by the transverse partition 62 into a primary sub-stoichiometric chamber 63 and a secondary portion which houses the ignition zone 68 of a secondary combustion chamber 41. The inlet 65 is sealed by a guillotine door 42 and combustible material may be introduced through the inlet 65 manually or by any conventional feeder. For instance when it is introduced as a solid it may be introduced by a ram feeder (not shown) through an entry duct 43. Alternatively the inlet and feeding arrangement for the subs-stoichiometric chamber 63 may be designed for receipt of other types of solid material or for receipt of liquid material, e.g., a slurry of combustible material.

The partition wall 62 is provided with apertures 44 and 45 near its top to serve as the outlet from the chamber for the off gases formed in the chamber by sub-stoichiometric combustion of the combustible material introduced through inlet 65. Some heat exchange occurs through the partition 62 between the ignition zone 68 and the off gases within the combustion chamber 63 but it is particularly preferred, as shown in FIGS. 6 and 8, for there to be heat exchange between off gases travelling along a path from the chamber 63, through a jacket surrounding part at least of the ignition zone, and into the ignition zone. As shown in FIG. 8 this path starts with the apertures 44 and 45 in the top of the partition wall, leads down through the jacket spaces 69 and 40 on either side of the ignition zone and into the base 46 of the ignition zone, this serving as the inlet for off gases into the ignition zone.

As illustrated, approximately half the wall area of the ignition zone is in indirect heat exchange contact with off gases in the jacket and, since the apertures 44 and 45 are substantially above the inlet 46 this heat exchange contact is countercurrent. One quarter of the wall area is in indirect heat exchange contact with the off gases within the chamber 63 and the remainder is in indirect heat exchange contact with the atmosphere.

In the invention it is preferred that at least half the wall area of the ignition zone is in indirect heat exchange contact with off gases within the chamber 63 or travelling along a path from the chamber 63 into the ignition zone. In particular it is preferred that substantially all the off gases that enter the ignition zone travel in indirect countercurrent heat exchange contact with the ignition zone before they enter into it.

There is an inlet 47 into the ignition zone for air or other supply of oxygen, often powered by a controllable blower 48. There may be a source of oxygen enrichment, e.g., close to the air inlet 47. Since the temperature of the off gases entering the ignition zone may sometimes be too low for spontaneous ignition upon contact with the air from the inlet 47 there is generally a support burner 49 that can be switched on or off according to the temperature of the off gases. This burner may be fuelled by gas or oil.

Although the heat exchange benefits and the compactness benefits of the invention might, in theory, be obtainable to some extent if the partition and the ignition zone were, for instance, horizontally arranged above the sub-stoichiometric combustion chamber the vertical arrangement illustrated in the drawings has the great advantage of being thermodynamically exceedingly efficient and of being very compact.

The secondary combustion chamber will generally have an elongated combustion zone that normally extends beyond the dimensions of the primary chamber and generally there is provision for the supply of additional air or other oxygen to the gases being burnt in the chamber 41 as they pass from the initial ignition zone and into and along the combustion zone. It is particularly preferred, as illustrated in FIG. 7 and as described in more detail in GB No. 1,570,276, for the secondary chamber 41 to include, between the ignition zone 68 and the combustion zone 50, a device comprising a nozzle 51 defining, with a venturi 52, a throat 53. By appropriate dimensioning and shaping of the nozzle 51 and the venturi 52 it is possible to obtain an accurate, and often a substantially automatically regulated, supply of air through the throat 53 into the stream of burning gases passing from the nozzle 51 into the venturi 52. Instead of or in addition to this arrangement it is also possible to supply air to the combustion zone 50 by any other means, for instance a blower similar to blower 48.

If desired the combustion zone 50 may be supplied with air at additional points along its length and may take the form of one or more combustion chambers arranged in series.

It is generally preferred that the amount of oxygen available for combustion in the sub-stoichiometric chamber is below 50% and most preferably below 30% of the stoichiometric amount, typically at least 20% and most preferably around 25% of the stoichiometric amount.

The amount of oxygen supplied to the ignition zone, for instance through inlet 47, is generally at least 30% and preferably at least 45% but is usually less than 80%, typically 50 to 75% of the total stoichiometric amount that is required. The amount of oxygen that is supplied to parts of the secondary chamber that are not in indirect heat exchange contact with the primary chamber or off gases travelling from the primary chamber to the secondary chamber, is usually at least 30% and often at least 50% of the total stoichiometric amount. The amount of oxygen that is consumed in the ignition zone, that is to say the part that is in indirect heat exchange contact with the primary chamber or the jacket, is usually at least 10% but preferably below 50%, typically 25 to 40%, of the total amount that is consumed in the process.

The total amount of oxygen that is provided is preferably such that there is at least 10% oxygen in the final exhaust.

The temperature of the off gases entering the ignition zone are generally above 500° C. but below 1,000° C., typically 650° to 800° C. These off gases are dirty combustible gases and when they are ignited, after the addition of air their temperature will increase and heat flux will be from within the chamber to the surrounding jacket and/or to the primary chamber.

The sub-stoichiometric chamber is preferably cylindrical with a diameter from 0.5 to 1.5, most preferably 0.8 to 1.2, times the horizontal length of the chamber. The transverse, length and height dimensions are typically each between about 0.8 and about 4 meters, often about 1 to about 2 meters. The incinerator is preferably made of a steel shell lined with refractory. Although the shell is preferably cylindrical in the primary portion, in the secondary portion the base of the shell may be horizontal, above the level of the base of the primary chamber, as illustrated in FIG. 8, since this can improve the flow of off gases into the inlet 66.

Although, for simplicity, it is not shown in FIGS. 6 to 8 preferably the refractory hearth 54 is provided with a central opening that occupies at least 25%, typically 40 to 90% and generally 60 to 80% of the area of the hearth, and a vibratable grid is fitted within this opening, for instance as illustrated in FIGS. 1 to 5.

The combustion chamber may be provided with a single inlet 65 in its end wall 55, opposite the transverse wall 62 but it is often preferred that the inlet 65, with the associated feeder mechanism 43, is provided in a side wall 56. The end wall 55 may then be closed or, preferably, it may be provided with an openable floor to allow access to the chamber. When the hearth 54 is provided with a vibratable grid the longitudinal bars of this may extend lengthwise (between walls 62 and 55) to an ash and trash outlet in one of the side walls, but preferably they extend between the end wall 55 and the partition 62 with an ash and trash outlet in end wall 55.

We claim:

1. An incinerator comprising a combustion chamber having an inlet for combustible material, a hearth comprising a grid with substantially parallel bars having a spacing of about 2 mm to about 10 mm, ash removal means for collecting ash that falls through the grid, a trash outlet from the combustion chamber and positioned at one end of the said bars for receiving trash off the grid, and a vibrator for vibrating the grid at an amplitude of less than about 10 mm and at a frequency of at least about 500 vibrations per minute with a movement that has a vertical component and a component substantially in the length direction of the said bars so as to move trash along the grid towards the trash outlet.

2. An incinerator comprising a combustion chamber having an inlet for combustible material, a hearth comprising a grid with substantially parallel bars having a spacing of about 2 mm to about 10 mm, ash removal means for collecting ash that falls through the grid, a trash outlet from the combustion chamber and positioned at one end of the said bars for receiving trash off the grid, and a vibrator for vibrating the grid at an amplitude of less than about 10 mm and at a frequency of at least about 500 vibrations per minute with a movement that has a vertical component and a component substantially in the length direction of the said bars so as to move trash along the grid towards the trash outlet; the combustion chamber is a sub-stoichiometric primary combustion chamber having an outlet for off gases produced in the chamber and the incinerator includes a secondary combustion chamber for receiving the off gases from the primary chamber and for combustion of them with oxygen; the secondary chamber comprises an ignition zone in which the off gases are ignited and which opens into a combustion zone in which combustion is substantially completed, there is an inlet for oxygen to the ignition zone, and there is a substantially vertical transverse partition separating the primary chamber from a second portion comprising the ignition zone and a substantially vertical jacket that surrounds part at least of the ignition zone and the ignition zone extends vertically upwards into the combustion zone, and there is at least one aperture through the partition at or near its top into the jacket for passage of off gases from the primary chamber into the jacket, and there is an inlet for off gases from the jacket into the ignition zone at a position below and distant from the aperture or apertures.

3. An incinerator comprising a combustion chamber having an inlet for combustible material, a hearth comprising a grid with substantially parallel bars having a spacing of about 2 mm to about 10 mm, ash removal means for collecting ash that falls through the grid, a trash outlet from the combustion chamber and positioned at one end of the said bars for receiving trash off the grid, and a vibrator for vibrating the grid at an amplitude of less than about 10 mm and at a frequency of at least about 500 vibrations per minute with a movement that has a vertical component and a component substantially in the length direction of the said bars so as to move trash along the grid towards the trash outlet; the combustion chamber comprises a refractory housing having an opening in its base having substantially the dimensions of the grid and the grid is mounted for vibration within the opening while the chamber is stationary; a trough beneath the grid is secured to the grid for vibration with the grid and the vibrator is positioned beneath the trough and acts on the trough.

4. An incinerator accordingly to claim 3 further comprising a housing that extends downwardly from the chamber around the opening and that is open to the lower side of the grid and that encloses the ash removal means, and the incinerator also comprises means for creating a higher pressure within the housing than in the combustion chamber.

5. An incinerator according to claim 1 in which the ash removing means comprise a trough positioned to receive ash that falls through the grid and a hopper arranged to receive the ash from the trough.

6. An incinerator according to claim 1 in which the ash removing means comprise a trough positioned to receive ash that falls through the grid and that is mounted to vibrate with the grid and a hopper arranged to receive the ash from the trough as a result of vibration of the grid and the trough.

7. An incinerator according to claim 6 in which the hopper is in a housing at one end of the chamber for receiving trash from the trash outlet.

8. An incinerator according to claim 1 in which the combustion chamber comprises a refractory housing having an opening in its base having substantially the dimensions of the grid and the grid is mounted for vibration within the opening while the chamber is stationary.

9. An incinerator according to claim 1 in which the chamber is a sub-stoichiometric primary combustion chamber having an outlet for off gases produced in the chamber and the incinerator includes a secondary combustion chamber for receiving the off gases from the primary chamber and for combustion of them with oxygen.

10. An incinerator according to claim 1 in which the chamber is a sub-stoichiometric primary combustion chamber having an outlet for off gases produced in the chamber and the incinerator includes a secondary combustion chamber for receiving the off gases from the primary chamber and for combustion of them with oxygen and in which air is supplied into the sub-stoichiometric chamber through the grid.

11. An incinerator according to claim 1 in which the chamber is a sub-stoichiometric primary combustion chamber having an outlet for off gases produced in the chamber and the incinerator includes a secondary combustion chamber for receiving the off gases from the primary chamber and for combustion of them with oxygen and in which air is supplied by air movement means to the sub-stoichiometric chamber substantially only throughout substantially the entire area of the grid and between the grid and the hearth.

12. An incinerator according to claim 1 in which the chamber is a sub-stoichiometric primary combustion chamber having an outlet for off gases produced in the chamber and the incinerator includes a secondary combustion chamber for receiving the off gases from the primary chamber and for combustion of them with oxygen and in which the inlet to the sub-stoichiometric chamber includes a door that can be opened automatically only when combustible solids are to be introduced and an automatic feed for combustible solids through the door.

13. An incinerator comprising a primary, sub-stoichiometric, combustion chamber having an inlet for combustible material, a hearth comprising a grid, ash removal means comprising a trough mounted on the grid for collecting ash that falls through the grid and a vibrator and in which the grid comprises substantially parallel bars having a spacing of about 2 to about 10 mm and is mounted for vibration within the hearth and with the trough by the vibrator positioned beneath and acting on the trough at an amplitude of less than about 10 mm and a frequency of at least about 500 vibrations per minute, air is supplied to within the trough at a pressure greater than the pressure in the chamber whereby air can flow up through the grid and between the grid and the housing, and the chamber has an outlet for off gases produced in the chamber and the incinerator includes a secondary combustion chamber for receiving the off gases from the primary chamber and for combustion of them with oxygen.

14. An incinerator according to claim 9 in which the secondary combustion chamber comprises an ignition zone in which the off gases are ignited and which opens into a combustion zone in which combustion is substantially completed and the incinerator includes an inlet for oxygen to the ignition zone and a path for off gases from within the primary chamber to the ignition zone, and this path provides indirect heat exchange contact between off gases approaching the ignition zone and the gases that are being burnt in the ignition zone.

15. An incinerator according to claim 1 in which the grid is mounted for vibration at a frequency within the range about 1000 to about 3600 vibrations per minute, the amplitude of the vibrations is about 0.5 to about 10 mm and the bars are about 2 to about 10 mm wide, and the vibration is substantially elliptical substantially in the length direction of the bars.

* * * * *